US011352594B2

(12) United States Patent
Bankar et al.

(10) Patent No.: US 11,352,594 B2
(45) Date of Patent: Jun. 7, 2022

(54) EXTRUDED SOAP BAR WITH HIGH WATER CONTENT

(71) Applicant: Conopco, Inc., Englewood Cliffs, NJ (US)

(72) Inventors: Pravin Bankar, Mumbai (IN); Venkata Satyanarayana Murthy Kamsu, Mumbai (IN); Simone Sethna, Mumbai (IN)

(73) Assignee: CONOPCO, INC., Englewood Cliffs, NJ (US)

( * ) Notice: Subject to any disclaimer, the term of this patent is extended or adjusted under 35 U.S.C. 154(b) by 0 days.

(21) Appl. No.: 17/425,115

(22) PCT Filed: Jan. 27, 2020

(86) PCT No.: PCT/EP2020/051915
§ 371 (c)(1),
(2) Date: Jul. 22, 2021

(87) PCT Pub. No.: WO2020/169306
PCT Pub. Date: Aug. 27, 2020

(65) Prior Publication Data

US 2022/0089984 A1 Mar. 24, 2022

(30) Foreign Application Priority Data

Feb. 19, 2019 (EP) ..... 19157900

(51) Int. Cl.
*C11D 13/18* (2006.01)
*C11D 9/02* (2006.01)
*C11D 9/22* (2006.01)
*C11D 13/00* (2006.01)

(52) U.S. Cl.
CPC ..... *C11D 13/18* (2013.01); *C11D 9/02* (2013.01); *C11D 9/225* (2013.01); *C11D 13/00* (2013.01)

(58) Field of Classification Search
CPC ..... C11D 13/18; C11D 9/02; C11D 9/225; C11D 13/00
See application file for complete search history.

(56) References Cited

U.S. PATENT DOCUMENTS

| | | | |
|---|---|---|---|
| 2,686,761 | A | 8/1954 | Ferguson et al. |
| 2,798,053 | A | 7/1957 | Brown |
| 4,297,230 | A | 10/1981 | Rasser |
| 4,678,593 | A | 7/1987 | Ridley |
| 4,891,149 | A | 1/1990 | Nagarajan et al. |
| 4,969,925 | A | 11/1990 | Sisco et al. |
| 5,194,172 | A | 3/1993 | Taneri et al. |
| 5,225,097 | A | 7/1993 | Kacher et al. |
| 5,264,144 | A | 11/1993 | Moroney et al. |
| 5,425,892 | A | 6/1995 | Taneri et al. |
| 5,703,026 | A | 12/1997 | Setser et al. |
| 5,952,289 | A | 9/1999 | Wise et al. |
| 6,143,704 | A | 11/2000 | Van Gunst et al. |
| 2002/0016271 | A1 | 2/2002 | Racherla |
| 2002/0155982 | A1 | 10/2002 | Bauer et al. |
| 2004/0157756 | A1 | 8/2004 | Kuroda |
| 2009/0143267 | A1 | 6/2009 | Zhang et al. |
| 2009/0286706 | A1 | 11/2009 | Chakrabarty et al. |
| 2012/0058164 | A1 | 3/2012 | Merchant et al. |
| 2014/0053508 | A1 | 2/2014 | Chourey et al. |
| 2014/0378363 | A1 | 12/2014 | Thiessies et al. |

FOREIGN PATENT DOCUMENTS

| | | |
|---|---|---|
| EP | 0014502 | 8/1980 |
| GB | 1333042 | 10/1973 |
| GB | 2231882 | 11/1990 |
| GB | 2238316 | 5/1991 |
| GB | 2459093 | 10/2009 |
| IN | 286834 | 2/2012 |
| JP | 2004256805 | 9/2004 |
| WO | WO9732965 | 9/1997 |
| WO | WO0246341 | 6/2002 |
| WO | WO2004000988 | 12/2003 |
| WO | WO2006053708 | 5/2006 |
| WO | WO2006097238 | 9/2006 |
| WO | WO2008071561 | 6/2008 |
| WO | WO2010089269 | 8/2010 |
| WO | WO2010140380 | 12/2010 |
| WO | WO2017016803 | 2/2017 |
| WO | WO2017016807 | 2/2017 |
| WO | WO2017202577 | 11/2017 |
| WO | WO2020169392 | 8/2020 |
| WO | WO2020169409 | 8/2020 |

OTHER PUBLICATIONS

Search Report and Written Opinion in EP19157897; dated Sep. 3, 2019; European Patent Office (EPO).
Search Report and Written Opinion in EP19157900; dated Sep. 3, 2019; European Patent Office (EPO).
Search Report and Written Opinion in EP19157894; dated Sep. 2, 2019; European Patent Office (EPO).
Search Report and Written Opinion in PCTEP2020051915; dated Apr. 22, 2020; World Intellectual Property Org. (WIPO).
Search Report and Written Opinion in PCTEP2020053443; dated Apr. 22, 2020; World Intellectual Property Org. (WIPO).
Written Opinion 2 in PCTEP2020053338; dated Feb. 5, 2021; World Intellectual Property Org. (WIPO).

(Continued)

*Primary Examiner* — Deborah D Carr
(74) *Attorney, Agent, or Firm* — Krista A. Kostiew

(57) ABSTRACT

The present invention relates to an extruded soap bar composition. It more particularly relates to a soap bar composition which comprises low amount of soap where high amount of water can be incorporated. This is achieved by including selective amount of a mixture of sodium or calcium silicate and an acrylic/acrylate polymer, wherein the soap bar comprises 0.01 to 0.7 wt % of the polymer. The soap bars of the invention are easy to extrude and has acceptable product hardness.

10 Claims, No Drawings

(56) References Cited

OTHER PUBLICATIONS

IPRP2 in PCTEP2020051915; dated Jun. 11, 2021; World Intellectual Property Org. (WIPO).

IPRP2 in PCTEP2020053338; dated Apr. 5, 2021; World Intellectual Property Org. (WIPO).

Search Report and Written Opinion in PCTEP2020053338; dated Apr. 21, 2020; World Intellectual Property Org. (WIPO).

Mineral Body Bar; Zeosoft; 2019; pp. 1-2; https://zeosoft.co.nz/product/mineral-body-bar/; New Zealand.

EXTRUDED SOAP BAR WITH HIGH WATER CONTENT

CROSS REFERENCE TO RELATED APPLICATIONS

The present application is a U.S. National Phase Application under 35 U.S.C. § 371 of International Application No. PCT/EP2020/051915, filed on Jan. 27, 2020, which claims priority to European Patent Application No. 19157900.2, filed on Feb. 19, 2019, the contents of which are incorporated herein in their entireties.

FIELD OF THE INVENTION

The present invention relates to an extruded soap bar composition. It more particularly relates to a soap bar composition that comprises high amount of water and yet is easy to extrude and stamp.

BACKGROUND OF THE INVENTION

Surfactants have been used for personal wash applications for a long time. There are many categories of products in the personal wash market e.g. body wash, face wash, hand wash, soap bars, shampoos etc. Products which are marketed as body wash, face wash and shampoos are generally in liquid form and are made of synthetic anionic surfactants. They are generally sold in plastic bottles/containers. Soap bars and hand wash products generally contain soaps. Soap bars do not need to be sold in plastic containers and are able to retain their own shape by virtue of being structured in the form of a rigid solid. Soaps bars are usually sold in cartons made of cardboard.

Soap bars are generally prepared through one of two routes. One is called the cast bar route while the other is called the milled and plodded route (also known as extrusion route). The cast bar route has inherently been very amenable in preparing low TFM (total fatty matter) bars. Total fatty matter is a common way of defining the quality of soap. TFM is defined as the total amount of fatty matter, mostly fatty acids, that can be separated from a sample of soap after splitting with a mineral acid, usually hydrochloric acid. In the cast bar soaps, the soap mixture is mixed with polyhydric alcohols and poured in casts and allowed to cool and then the soap bars are removed from the casts. The cast bar route enables production at relatively lower throughput rates.

In the milled and plodded route, the soap is prepared with high water content and then spray dried to reduce the moisture content and to cool the soap after which other ingredients are added and then the soap is extruded through a plodder and optionally cut and stamped to prepare the final soap bar. The milled and plodded soaps generally have a high TFM in the range of 60 to 80 weight percent.

Milled and plodded soap bars are also known as extruded soap bars. They are composed of very many different types of soaps. Most soap compositions comprise both water insoluble as well as water soluble soaps. Their structure is generally characterized by a brick and mortar type structure. Insoluble soaps (called bricks) usually consist of higher chain C16 and C18 soaps (stearate and palmitate soap). They are generally included in soap bars to provide structuring benefits i.e they provide shape to the bars. Soap bars also consist of water soluble soaps (which act as the mortar) which are generally unsaturated C18:1 and 18:2 sodium soap (oleate soap) in combination with short chain fatty acids (generally C8 to C12 or even up to C14 soap). Water soluble soaps generally aid in cleaning.

In addition to about the 60 to 80 wt % TFM, soap bars presently prepared through the extruded route for personal wash contain about 14 to 21 wt % water. There is a need for developing sustainable technologies where one approach is to develop soaps with lower TFM content and by increasing the water content with no compromise on the cleaning efficacy or bar integrity/sensorials as could be observed with properties like lather produced, rate of wear or mush. The present inventors are aware of various attempts by the present applicants and others to reduce the fatty matter content. These technologies include approaches to structure soap bars, like inclusion of aluminium phosphate. Such technologies are useful for preparing bars for laundering application but such materials are not very skin friendly and so are not appropriate for personal washing. If one simply substitutes the TFM with higher amount of water, it causes problems during extrusion of the soap mass and further the extruded bars are sticky and cannot be stamped easily. The present inventors are also aware of various other approaches like inclusion of natural aluminosilicate clays like bentonite or kaolinite but they are found to not be very efficient in structuring the bars at low amounts.

U.S. Pat. No. 5,703,026 A (P&G, 1997) discloses a skin cleansing bar soap composition comprising (a) from about 40 to about 95% surfactant component comprising fatty acid soap and/or synthetic surfactant, such that the composition comprises: (i) from 0 to 95% fatty acid soap; and (ii) from 0% to about 50% synthetic surfactant; (b) particles of absorbent gellant material, dry weight basis, in the composition being from about 0.02% to about 5%, the absorbent gellant material having an extractable polymer content of less than about 25%; and (c) from about 5 to about 35% water and additionally other optional ingredients.

GB2238316 A (Unilever, 1991) discloses a toilet or laundry bar comprising 30 to 70% by weight of soap or a mixture of soap and synthetic detergent reckoned as anhydrous; 0.1 to 20% by weight of mineral or organic acid; 5 to 30% by weight alkaline silicate; and 10 to 40% by weight of water.

WO02/46341 A1 (Unilever) discloses a process for preparing low density detergent bar comprising high levels of water and other liquid benefit agents by in situ generation of boro-silicate containing structuring system. The invention is based on the finding that that in the manufacture of non-granular high moisture solid detergent product for personal wash or fabric wash or hard surface cleaning, in situ generation of boron containing structuring system such as borosilicate or boro-silicate in presence of an aluminium and/or phosphate salt to obtain boro-aluminosilicate or boro-aluminophospho-silicate imparts good processability, in-use properties and improved water retention capacity.

US2014378363 A1 (Henkel) discloses low TFM soap bars containing talcum, starch and silicates. Talcum, starch and silicates constitute the structuring system.

WO2017/202577 A1 (Unilever) discloses soap bars that are structured by situ generation of hydroxide of a trivalent metal ion by addition of a trivalent salt of a metal and a hydroxide of an alkali metal. This results in milled soap bars with significantly better sensory properties such as lather, average wear rate and mush.

Thus, soap bars with alkaline silicate have been known and prepared in the past. The present inventors find that merely including sodium silicate in a low TFM soap bar composition does not give the desired hardness that is found in high TFM soap bars. Further high amounts of sodium silicate causes the problem known as efflorescence in the bars on storage. Although soap bars with polymers included there are known, it was to the surprise of the present inventors that small amounts of specific polymer of the acrylic/acrylate class in a low TFM soap bar with high water content and also comprising a silicate compound was able to structure soap bars to the desired hardness as presently achieved with high TFM bars. Further, they found that with the inclusion of the polymer, lower amount of silicate had to be included thus achieving synergistic benefits with the combination of the two structuring agents.

It is thus an object of the present invention to provide for a low TFM soap bar which can be prepared using the extrusion route and is easily and conveniently stampable.

It is another object of the present invention to provide for a low TFM soap bar which in addition to being conveniently extrudable and stampable does not compromise on the bar integrity and delivers the desired sensorial properties like high lather and low mush.

SUMMARY OF THE INVENTION

The present invention relates to an extruded soap bar comprising (i) 40 to 60 wt % TFM;

(ii) 21 to 40 wt % water;

(iii) 0.5 to 5 wt % electrolyte; and (iv) 0.5 to 10 wt % of a structuring system comprising a mixture of sodium or calcium silicate and an acrylic/acrylate polymer, wherein said soap bar comprises 0.01 to 0.7 wt % of said polymer.

Another aspect of the present invention relates to a process to prepare the soap bar of the invention comprising the step of including substantially all of the structuring system to the soap when it is being produced during the saponification step.

DETAILED DESCRIPTION OF THE INVENTION

These and other aspects, features and advantages will become apparent to those of ordinary skill in the art from a reading of the following detailed description and the appended claims. For the avoidance of doubt, any feature of one aspect of the present invention may be utilized in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description and claims indicating amounts of material or conditions of reaction, physical properties of materials and/or use are to be understood as modified by the word "about". Numerical ranges expressed in the format "from x to y" are understood to include x and y. When for a specific feature multiple preferred ranges are described in the format "from x to y", it is understood that all ranges combining the different endpoints are also contemplated.

The present invention relates to a soap bar composition. By a soap bar composition is meant a cleansing composition comprising soap which is in the form of a shaped solid. The soap bar of the invention is especially useful for personal cleansing. The soap bar of the present invention comprises 40 to 60% total amount of TFM from soap, preferably 40 to 55%, more preferably 45 to 55 wt % TFM from soap. The term soap means salt of fatty acid. Preferably, the soap is soap of C8 to C24 fatty acids. The cation may be an alkali metal, alkaline earth metal or ammonium ion, preferably alkali metals. Preferably, the cation is selected from sodium or potassium, more preferably sodium. The soap may be saturated or unsaturated. Saturated soaps are preferred over unsaturated soaps for stability. The oil or fatty acids may be of vegetable or animal origin.

The soap may be obtained by saponification of oils, fats or fatty acids. The fats or oils generally used to make soap bars may be selected from tallow, tallow stearins, palm oil, palm stearins, soya bean oil, fish oil, castor oil, rice bran oil, sunflower oil, coconut oil, babassu oil, and palm kernel oil. The fatty acids may be from coconut, rice bran, groundnut, tallow, palm, palm kernel, cotton seed or soyabean.

The fatty acid soaps may also be synthetically prepared (e.g. by the oxidation of petroleum or by the hydrogenation of carbon monoxide by the Fischer-Tropsch process). Resin acids, such as those present in tall oil, may also be used. Naphthenic acids may also be used.

The soap bar may additionally comprise synthetic surfactants selected from one or more from the class of anionic, non-ionic, cationic or zwitterionic surfactants, preferably from anionic surfactants. These synthetic surfactants, as per the present invention, are included in less then 8%, preferably less then 4%, more preferably less then 1.5% and sometimes absent from the composition.

The composition of the present invention is in the form of a shaped solid for example a bar. The cleaning soap composition is generally a wash off products have sufficient amounts of surfactants included therein that it is used for cleansing the desired topical surface e.g. the whole body, the hair and scalp or the face. It is applied on the topical surface and left thereon only for a few seconds or minutes and washed off thereafter with copious amounts of water.

The soap bars of the present invention preferably includes low molecular weight soaps (C8 to C14 soaps) which are generally water soluble, which are in the range of 2 to 20% by weight of the composition. It is preferred that the soap bar includes 15 to 55 wt % of the soap of C16 to C24 fatty acid, which are generally water insoluble soaps. Unsaturated fatty acid soaps preferably at 15 to 35% may also be included in the total soap content of the composition. Unsaturated soaps are preferably oleic acid soaps. The composition of the invention comprises a silicate compound preferably sodium silicate or calcium silicate, more preferably sodium silicate. Sodium silicate includes compounds having the formula $(Na_2O)_x.SiO_2$. The weight ratio of $Na_2O$ to $SiO_2$ could vary from 1:2 to 1:3.75. Grades of sodium silicate with ratio from about 1:2 to 1:2.85 are called alkaline silicate and with ratios from 1:2.85 to about 1:3.75 are called neutral silicate. Forms of sodium silicate that are available include sodium metasilicate ($Na_2SiO_3$), sodium pyrosilicate ($Na_6Si_2O_7$), and sodium orthosilicate ($Na_4SiO_4$). It is preferred as per this invention that alkaline sodium silicate is used. Especially preferred is alkaline sodium silicate with a ratio of 1:2. It is preferred that the soap bar comprises 0.01% to 3 wt % sodium silicate, on dry weight basis.

The composition of the invention includes a polymer of the acrylic/acrylate class. The polymer may be hydrophobically modified, a homo polymer, a copolymer, or a cross polymer which may be an acrylic polymer, a partially neutralized acrylic polymer or an acrylate polymer. Commercially available polymer of these classes which may be used include Carbopol Aqua SF polymer from Lubrizol, Carbopol SC-200 polymer also from Lubrizol, or Acusol 445 G-polymer from Dow. The polymer is included in 0.01 to 0.7%, preferably from 0.1 to 3%, furthermore preferably 0.2 to 2% by weight of the soap bar.

The soap bar of the invention is capable of stably retaining high amount of water as compared to conventional soap bar. The amount of water in the soap composition ranges from 21 to 40%, preferably 25 to 40%, more preferably 25 to 35%, furthermore preferably 25 to 33 by weight of the soap bar.

The soap bar composition generally comprises electrolyte and water. Electrolytes as per this invention include compounds that substantially dissociate into ions in water. Electrolytes as per this invention are not ionic surfactants. Suitable electrolytes for inclusion in the soap making process are alkali metal salts. Preferred alkali metal salts for inclusion in the composition of the invention include sodium sulfate, sodium chloride, sodium acetate, sodium citrate, potassium chloride, potassium sulfate, sodium carbonate and other mono or di or tri salts of alkaline earth metals, more preferred electrolytes are sodium chloride, sodium sulfate, sodium citrate, potassium chloride and especially preferred electrolyte is sodium chloride, sodium citrate or sodium sulphate or a combination thereof. For the avoidance of doubt, it is clarified that the electrolyte is a non-soap material. Electrolyte is included in 0.5 to 5%, preferably 0.5 to 3%, more preferably 1 to 2.5% by weight of the composition. It is preferred that the electrolyte is included in the soap bar during the step of saponification to form the soap. The soaps bar composition may optionally comprise 0.1 to 15%, preferably 0.1 to 12% by weight of free fatty acids. By free fatty acids is meant a carboxylic acid comprising a hydrocarbon chain and a terminal carboxyl group. Suitable fatty acids are C8 to C22 fatty acids. Preferred fatty acids are C12 to C18, preferably predominantly saturated, straight-chain fatty acids. However, some unsaturated fatty acids can also be employed.

The composition preferably comprises a polyhydric alcohol (also called polyol) or mixture of polyols. Polyol is a term used herein to designate a compound having multiple hydroxyl groups (at least two, preferably at least three) which is highly water soluble, preferably freely soluble, in water. Many types of polyols are available including: relatively low molecular weight short chain polyhydroxy compounds such as glycerol and propylene glycol; sugars such as sorbitol, manitol, sucrose and glucose; modified carbohydrates such as hydrolyzed starch, dextrin and maltodextrin, and polymeric synthetic polyols such as polyalkylene glycols, for example polyoxyethylene glycol (PEG) and polyoxypropylene glycol (PPG). Especially preferred polyols are glycerol, sorbitol and their mixtures. Most preferred polyol is glycerol. In a preferred embodiment, the bars of the invention comprise 0 to 8%, preferably 1 to 7.5% by wt. polyol.

The various optional ingredients that make up the final soap bar composition are as described below:

Organic and Inorganic Adjuvant Materials

The total level of the adjuvant materials used in the bar composition should be in an amount not higher than 50%, preferably 1 to 50%, more preferably 3 to 45% by wt. of the soap bar composition.

Suitable starchy materials which may be used include natural starch (from corn, wheat, rice, potato, tapioca and the like), pre-gelatinzed starch, various physically and chemically modified starch and mixtures thereof. By the term natural starch is meant starch which has not been subjected to chemical or physical modification—also known as raw or native starch.

The raw starch can be used directly or modified during the process of making the bar composition such that the starch becomes gelatinized, either partially or fully gelatinized.

The adjuvant system may optionally include insoluble particles comprising one or a combination of materials. By insoluble particles is meant materials that are present in solid particulate form and suitable for personal washing. Preferably, there are mineral (e.g., inorganic) or organic particles.

The insoluble particles should not be perceived as scratchy or granular and thus should have a particle size less than 300 microns, more preferably less than 100 microns and most preferably less than 50 microns.

Preferred inorganic particulate material includes talc and calcium carbonate. Talc is a magnesium silicate mineral material, with a sheet silicate structure and a composition of $Mg_3Si_4(OH)_{22}$ and may be available in the hydrated form. It has a plate-like morphology, and is essentially oleophilic/hydrophobic, i.e., it is wetted by oil rather than water.

Calcium carbonate or chalk exists in three crystal forms: calcite, aragonite and vaterite. The natural morphology of calcite is rhombohedral or cuboidal, acicular or dendritic for aragonite and spheroidal for vaterite.

Examples of other optional insoluble inorganic particulate materials include aluminates, phosphates, insoluble sulfates, borates and clays (e.g., kaolin, china clay) and their combinations.

Organic particulate materials include: insoluble polysaccharides such as highly crosslinked or insolubilized starch (e.g., by reaction with a hydrophobe such as octyl succinate) and cellulose; synthetic polymers such as various polymer lattices and suspension polymers; insoluble soaps and mixtures thereof.

Bar compositions preferably comprise 0.1 to 25% by wt. of bar composition, preferably 5 to 15 by wt. of these mineral or organic particles.

An opacifier may be optionally present in the personal care composition. When opacifiers are present, the cleansing bar is generally opaque. Examples of opacifiers include titanium dioxide, zinc oxide and the like. A particularly preferred opacifier that can be employed when an opaque soap composition is desired is ethylene glycol mono- or di-stearate, for example in the form of a 20% solution in sodium lauryl ether sulphate. An alternative opacifying agent is zinc stearate.

The product can take the form of a water-clear, i.e. transparent soap, in which case it will not contain an opacifier.

The pH of preferred soaps bars of the invention is from 8 to 11, more preferably 9 to 11.

A preferred bar may additionally include up to 30 wt % benefit agents. Preferred benefit agents include moisturizers, emollients, sunscreens, skin lightening agents and anti-ageing compounds. The agents may be added at an appropriate step during the process of making the bars. Some benefit agents may be introduced as macro domains.

Other optional ingredients like anti-oxidants, perfumes, polymers, chelating agents, colourants, deodorants, dyes, emollients, moisturizers, enzymes, foam boosters, germicides, additional anti-microbials, lathering agents, pearlescers, skin conditioners, stabilisers, superfatting agents, sunscreens may be added in suitable amounts in the process of the invention. Preferably, the ingredients are added after the saponification step. Sodium metabisulphite, ethylene diamine tetra acetic acid (EDTA), borax or ethylene hydroxy diphosphonic acid (EHDP) are preferably added to the formulation. The composition of the invention could be used to deliver antimicrobial benefits. Antimicrobial agents that are preferably included to deliver this benefits include oligodynamic metals or compounds thereof. Preferred metals are silver, copper, zinc, gold or aluminium. Silver is particularly preferred. In the ionic form it may exist as a salt or any compound in any applicable oxidation state. Preferred silver compounds are silver oxide, silver nitrate, silver acetate, silver sulfate, silver benzoate, silver salicylate, silver carbonate, silver citrate and silver phosphate, with silver oxide, silver sulfate and silver citrate being of particular interest in one or more embodiments. In at least one preferred embodiment the silver compound is silver oxide. Oligodynamic metal or a compound thereof is preferably included in 0.0001 to 2%, preferably 0.001 to 1% by weight of the composition. Alternately an essential oil antimicrobial active may be included in the composition of the invention. Preferred essential oil actives which may be included are terpineol, thymol, carvacol, (E)-2(prop-1-enyl) phenol, 2-propylphenol, 4-pentylphenol, 4-sec-butylphenol, 2-benzyl phenol, eugenol or combinations thereof. Further more preferred essential oil actives are terpineol, thymol, carvacrol or thymol, most preferred being terpineol or thymol and ideally a combination of the two. Essential oil actives are preferably included in 0.001 to 1%, preferably 0.01 to 0.5% by weight of the composition.

The soap composition may be made into a bar by a process that first involves saponification of the fat charge with alkali followed by extruding the mixture in a conventional plodder. The plodded mass may then be optionally cut to a desired size and stamped with a desirable indicia. An especially important benefit of the present invention is that, notwithstanding the high amount of water content of the soap bar, compositions thus prepared by extrusion are found to be easy to stamp with a desirable indicia.

The present invention also relates to a process to prepare the soap bar of the invention comprising the step of including substantially all of the structuring system to the soap when it is being produced during the saponification step. Preferably, at least, the polymer is included during the saponification stage.

The invention will now be illustrated by means of the following non-limiting examples.

EXAMPLES

Example A-D and 1-2: Effect of Soap Bars Outside and within the Invention on Extrudability and Product Hardness The following four soap bar compositions as shown in Table-1 were prepared.

The following method was used to measure the product hardness:

Hardness Testing Protocol

Principle

A 30° conical probe penetrates into a soap/syndet sample at a specified speed to a pre-determined depth. The resistance generated at the specific depth is recorded. There is no size or weight requirement of the tested sample except that the bar/billet be bigger than the penetration of the cone (15 mm) and have enough area. The recorded resistance number is also related to the yield stress and the stress can be calculated as noted below. The hardness (and/or calculated yield stress) can be measured by a variety of different penetrometer methods. In this invention, as noted above, we use probe which penetrates to depth of 15 mm.

Apparatus and Equipment

TA-XT Express (Stable Micro Systems)

30° conical probe—Part #P/30c (Stable Micro Systems)

Sampling Technique

This test can be applied to billets from a plodder, finished bars, or small pieces of soap/syndet (noodles, pellets, or bits). In the case of billets, pieces of a suitable size (9 cm) for the TA-XT can be cut out from a larger sample. In the case of pellets or bits which are too small to be mounted in the TA-XT, the compression fixture is used to form several noodles into a single pastille large enough to be tested.

Procedure

Setting Up the TA-XT Express

These settings need to be inserted in the system only once. They are saved and loaded whenever the instrument is turned on again. This ensures settings are constant and that all experimental results are readily reproducible.

Set Test Method

Press MENU

Select TEST SETTINGS (Press 1)

Select TEST TPE (Press 1)

Choose option 1 (CYCLE TEST) and press OK

Press MENU

Select TEST SETTINGS (Press 1)

Select PARAMETERS (Press 2)

Select PRE TEST SPEED (Press 1)

Type 2 (mm $s^{-1}$) and press OK

Select TRIGGER FORCE (Press 2)

Type 5 (g) and Press OK

Select TEST SPEED (Press 3)

Type 1 (mm $s^{-1}$) and press OK

Select RETURN SPEED (Press 4)

Type 10 (mm $s^{-1}$) and press OK

Select DISTANCE (Press 5)

Type 15 (mm) for soap billets or 3 (mm) for soap pastilles and press OK

Select TIME (Press 6)

Type 1 (CYCLE)

Calibration

Screw the probe onto the probe carrier.

Press MENU

Select OPTIONS (Press 3)

Select CALIBRATE FORCE (Press 1)—the instrument asks for the user to check whether the calibration platform is clear Press OK to continue and wait until the instrument is ready.

Place the 2 kg calibration weight onto the calibration platform and press OK

Wait until the message "calibration completed" is displayed and remove the weight from the platform.

Sample Measurements

Place the billet onto the test platform.

Place the probe close to the surface of the billet (without touching it) by pressing the UP or DOWN arrows.

Press RUN

Take the readings (g or kg) at the target distance (Fin).

After the run is performed, the probe returns to its original position.

Remove the sample from the platform and record its temperature.

Calculation & Expression of Results

Output

The output from this test is the readout of the TA-XT as "force" ($R_T$) in g or kg at the target penetration distance, combined with the sample temperature measurement. (In the subject invention, the force is measured in Kg at 40° C. at 15 mm distance)

The force reading can be converted to extensional stress, according to the equation given below.

The equation to convert the TX-XT readout to extensional stress is $$\sigma = \frac{1}{C}\frac{R_T g_c}{A}$$

where: σ=extensional stress

C="constraint factor" (1.5 for 30° cone)

$G_c$=acceleration of gravity

A=projected area of cone=$\pi(d \tan \frac{1}{2}\theta)^2$ d=penetration depth

θ=cone angle

For a 30° cone at 15 mm penetration, Equation 2 becomes $$\sigma(\text{Pa}) = R_T(\text{g}) \times 128.8$$

This stress is equivalent to the static yield stress as measured by penetrometer. The extension rate is:

$$\dot{\varepsilon} = \frac{V}{d\tan\left(\frac{1}{2}\theta\right)}$$

where $\dot{\varepsilon}$=extension rate ($s^{-1}$)

V=cone velocity

For a 30° cone moving at 1 mm/s, $\dot{\varepsilon}$=0.249 $s^{-1}$

Temperature Correction

The hardness (yield stress) of skin cleansing bar formulations is temperature-sensitive. For meaningful comparisons, the reading at the target distance ($R_T$) should be corrected to a standard reference temperature (normally 40° C.), according to the following equation:

$$R_{40} = R_T \times \exp[\alpha(T-40)]$$

where $R_{40}$=reading at the reference temperature (40° C.)

$R_T$=reading at the temperature T

α=coefficient for temperature correction

T=temperature at which the sample was analyzed.

The correction can be applied to the extensional stress.

Raw and Processed Data

The final result is the temperature-corrected force or stress, but it is advisable to record the instrument reading and the sample temperature also.

A hardness value of at least 1.2 kg (measured at 40° C.), preferably at least 2.7 kg is acceptable.

TABLE 1

| Ingredient (wt %) | A | B | C | D | 1 | 2 |
|---|---|---|---|---|---|---|
| TFM | 52 | 53 | 54 | 53 | 54 | 51 |
| Talc | 3.0 | 3.0 | 3.0 | 3.0 | 3.0 | 3.0 |
| AOS | 1.0 | 1.0 | 1.0 | 1.0 | 1.0 | 1.0 |
| Sodium sulphate | 1.2 | 1.2 | 1.2 | 1.2 | 1.2 | 1.2 |
| Sodium chloride | 0.9 | 0.9 | 0.9 | 0.9 | 0.9 | 0.9 |
| Alkaline sodium silicate | 2.0 | 1.0 | — | — | 1.5 | 1.5 |
| Glycerin | 4.0 | 4.0 | 4.0 | 4.0 | 4.0 | 5.0 |
| Free Fatty acid | 0.15 | 0.15 | 0.15 | 0.15 | 0.15 | 0.15 |
| Carbopol ® SC200 | — | — | 0.5 | 1.0 | 0.4 | 0.5 |
| Water | 30.8 | 30.6 | 29.6 | 29.6 | 28.1 | 29.8 |
| Extrudability | Poor | Poor | Poor | Poor | Good | Good |
| Product hardness (kg) | 2.59 | 2.28 | 1.84 | 2.34 | 3.57 | 3.35 |

Note:
AOS: Synthetic anionic surfactant Alpha olefin sulphonate

The data in the above table indicates that compositions within the invention (Examples 1 and 2) are easy to extrude and have good product hardness. Example A to D are outside the invention (either does not contain sodium silicate or polymer) and have low product hardness and are difficult to extrude.

The invention claimed is:

1. An extruded soap bar comprising:

(i) 40 to 60 wt % total fatty matter;

(ii) 21 to 40 wt % water;

(iii) 0.5 to 5 wt % electrolyte; and (iv) 0.1 to 10 wt % of a structuring system comprising a mixture of sodium silicate and an acrylic/acrylate polymer, wherein said soap bar comprises 0.01 to 0.7 wt % of said polymer, wherein said soap bar comprises 0.5 to 3 wt % sodium silicate.

2. The soap bar as claimed in claim 1, comprising 45 to 55 wt % total fatty matter.

3. The soap bar as claimed in claim 1, comprising 25 to 40 wt % water.

4. The soap bar as claimed in claim 1, comprising 0.5 to 3 wt % electrolyte.

5. The soap bar as claimed in claim 1, wherein said electrolyte is selected from sodium chloride, sodium sulphate, sodium citrate or a mixture thereof.

6. The soap bar as claimed in claim 1, comprising sodium silicate.

7. The soap bar as claimed in claim 1, wherein said polymer is a hydrophobically modified, a homo polymer, a copolymer, or a cross polymer.

8. A process to prepare a soap bar as claimed in claim 1, comprising the step of including the polymer during the step of saponification to form the soap.

9. The soap bar as claimed in claim 7, wherein the sodium silicate is alkaline sodium silicate with a $Na_2O:SiO_2$ weight ratio of about 1:2.

10. The soap bar as claimed in claim 7, wherein the polymer is an acrylic polymer, a partially neutralized acrylic polymer, or an acrylate polymer.

* * * * *